United States Patent [19]

Nystrand

[11] 4,204,669

[45] May 27, 1980

[54] METHOD AND APPARATUS FOR ZIG-ZAG FOLDING

[75] Inventor: Ernst D. Nystrand, De Pere, Wis.

[73] Assignee: Paper Converting Machine Company, Green Bay, Wis.

[21] Appl. No.: 967,494

[22] Filed: Dec. 7, 1978

Related U.S. Application Data

[63] Continuation-in-part of Ser. No. 823,350, Aug. 10, 1977, abandoned.

[51] Int. Cl.[2] ..... B65H 45/16

[52] U.S. Cl. ..... 270/73

[58] Field of Search ..... 270/73, 39, 79

[56] References Cited

U.S. PATENT DOCUMENTS

| | | | |
|---|---|---|---|
| 2,359,417 | 10/1944 | Hand | 270/73 |
| 3,195,882 | 7/1965 | Nystrand | 270/73 |
| 3,214,162 | 10/1965 | Breidenbach | 270/73 |
| 3,406,959 | 10/1968 | Ross | 270/73 |
| 3,762,699 | 10/1973 | Wing | 270/73 |
| 3,883,131 | 5/1975 | Anderson | 270/79 |

*Primary Examiner*—Edgar S. Burr
*Assistant Examiner*—A. J. Heinz
*Attorney, Agent, or Firm*—Tilton, Fallon, Lungmus & Chestnut

[57] ABSTRACT

A method and apparatus for zig-zag folding in which stack lean can be corrected by angularly shifting one gripper-tucker member relative to the other where the gripper anvil tip and the gripper element tip are each a constant distance from the tucker tip during entry of the tucker into the gripper.

5 Claims, 18 Drawing Figures

3
3
32
35
36
37
31
33
29
34
28
30
15
26
27
11
11'
27'
23
23'

13
45
G
W
25
L
T
A
a
b
24
12
13'
50
51
52
49
48
47
46

T

13'

53

METHOD AND APPARATUS FOR ZIG-ZAG FOLDING

This is a continuation-in-part of my co-pending application Ser. No. 823,350 filed Aug. 10, 1977, now abandoned.

BACKGROUND AND SUMMARY OF INVENTION

This invention relates to a method and apparatus for zig-zag folding and, more particularly, constitutes an improvement over my prior U.S. Pat. No. 3,195,882. In that patent, to achieve higher speeds, the tip of the gripper anvil traced an envelope having a greater diameter than the envelope traced by the tucker tip. This represented a departure from the prior art which itself was improved by my prior U.S. Pat. No. 3,489,406. However, both of these patents deal with mechanically controlled grippers as contrasted to the resilient form of gripper of my U.S. Pat. No. 3,947,013.

The instant invention has to do with the first type of folding wherein the grippers are mechanically controlled. However, notwithstanding the precision ostensibly available from mechanically controlled grippers, it has become increasingly difficult to develop folds at precise locations, i.e., along spaced apart lines of transverse perforation.

It will be appreciated that a great demand exists for zig-zig folded forms for use in computers. Computers, particularly the print-out mechanisms, have been operating at ever-increasing speeds. Anything that interferes with the achievement of the higher speeds is, of course, undesirable and disadvantageous. One of these undesirable phenomenon is that of stack "lean". By this, I refer to the fact that a free-standing stack, when viewed from the side, and parallel to the fold lines, assumes a parallelogram type of contour rather than the desired rectangle. This can be noted quickly during the process of manufacture but heretofore nothing has been done to correct this without stopping the machine.

I have ascertained that stack "lean" results from alternate forms or folds being longer than those intervening. The length of forms or folds normally is determined by the lines of transverse perforation existing in the sheet, and I have noted that in prior folders, the tucker and gripper about to enter into engagement "hunt" to find the line of perforation, i.e., the weakest area in the portion of the web being folded. The difference in length between adjacent lines of perforation in adjacent forms may be only of the order of a few thousandths of an inch but it still results in the undesirable stack "lean".

I have ascertained that the undesirable "lean" which can disrupt the operation of the computer print mechanism by virtue of failing to feed properly, can be overcome by a slight annular shift of one folding member relative to the other provided certain geometrical relations are present—and this during operation so that the results thereof can be immediately ascertained.

Here it will be appreciated that there has been a demand for increasing speeds of production because there has been a shift to single part business forms—the ease and economy with which reproduction can be made by xerographic type machines making it unnecessary to have multiple part forms. Thus, to maintain a given output of business forms, the forms manufacturer is desirous of operating at higher speeds which is reflected in differential tensions in the web which can result in slight mislocations in the lines of transverse perforation. Even where the lines of perforation are exactly spaced, lean may result from the operation of the folder. So the invention is concerned with correcting lean irrespective of the cause.

For example, I have noted machines that were able to produce straight stacks up to 800 FPM but leaning stacks occurred at 1000 FPM. Two-wide folders may have one folder that produces straight stacks under certain conditions while the other produces leaning stacks. Change of parent rolls often changes the end product from straight to leaning stacks. All in all it can be and often is a costly, time consuming, as well as an exasperating thing to try to analyze and correct.

With my system there is no need to analyze the reason why a folded stack is leaning. The operator simply turns a handwheel a bit while the machine is operating at full speed and the correction is made.

The problem of stack "lean" is substantially eliminated in the system described through the use of helical mating gears on the folding members whereby very slight angular adjustments can be made "on the fly". Such type of gearing has not been used, to the best of my knowledge, on folding rolls although such gearing has been used in adjusting the mating engagement of perforation rolls.

Throughout the years, this has not been achievable and I have discovered that this stems from the fact that all the prior folders provided surplus web material above the folding rolls. For example, one widely employed folder is seen in U.S. Pat. No. 2,626,145 and the operation there involved the web-delivering means being actuated so as to deliver the web at a rate of travel greater than the rate of travel of the gripper jaws.

The system of this invention which makes possible the angular adjustment to correct lean requires that the outer edge or the tip of the gripper anvil travel at web speed, the tolerance being plus nothing to a few thousands of an inch minus per foot of web.

Further, as the tucker edge forces the perforated line of the web down between the gripper anvil and the gripper to its deepest penetration the distance between the outer edge of the gripper anvil and the tucker edge must remain constant. In the meantime the gripper which is cam actuated but spring loaded against the tucker is keeping a constant distance between the tucker and gripper edges.

Thus, from the instant that the tucker blade edge contacts the paper to the point of deepest penetration there is no relative movement or slippage between the web and the tucker edge. As the web will fold at the part of perforation that contacts the tucker edge it becomes possible by a slight angular movement of the tucker relative to the gripper to create a different fold line within the limits of the perforation width. Also, it is to be realized that the perforated line does have width. This width increases as the edge of the perforating blade wears to a distinctive flat after a few hours of use.

DETAILED DESCRIPTION

The invention is described in conjunction with an illustrative embodiment in the accompanying drawing, in which FIG. 1 is a fragmentary elevational view of the folding and stacking portion of a business form producing machine;

Figure 1:
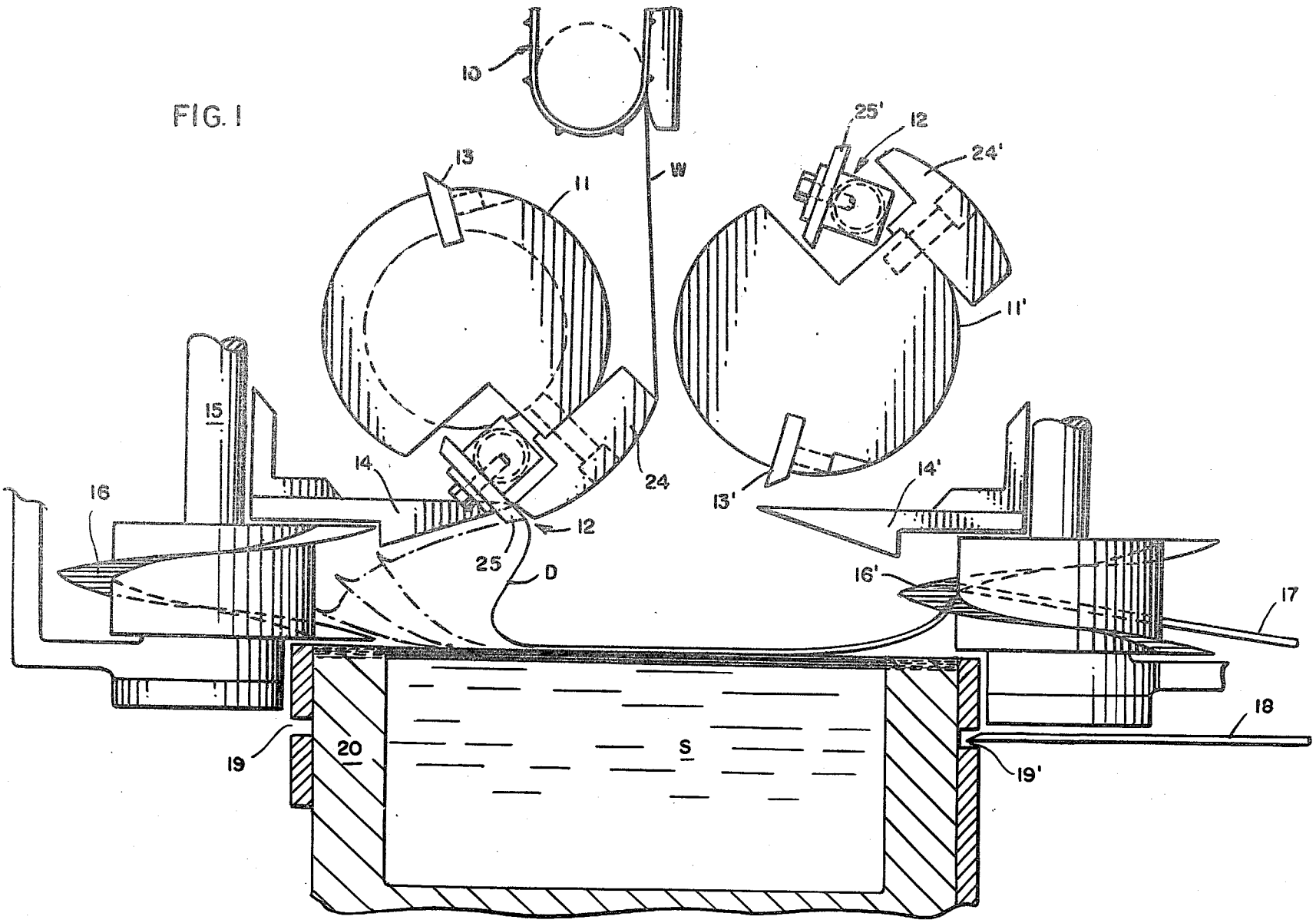

In the illustration given, and with reference first to FIG. 1, the numeral 10 designates generally a pin belt feed mechanism which is operative to advance a web W along a predetermined path. The web proceeds between folding members 11, 11', one being a mirror image of the other. Each member is mounted for rotation abut an axis with the axes of the two members being parallel. Each member includes a gripper 12 (or 12') and a tucker 13, 13'. The members 11, 11' are in a predetermined angular orientation relative to each other so as to position the tucker 13 in web tucking engagement with the tucker 13' of the member 11; cooperates with the gripper 13 of the element 11.

Before going into the details of construction and operation of the folding members and the tuckers and grippers thereof, the remaining portion of the apparatus and method will be described to place the same in perspective.

Figure 4:
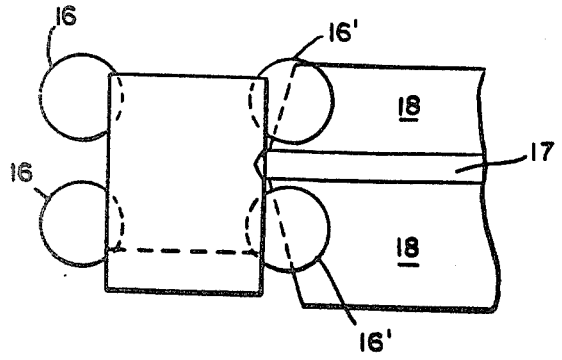
FIG. 4 is a fragmentary plan view, essentially schematic, such as would be seen along the sight line 4—4 of FIG. 1.
Figure 5:
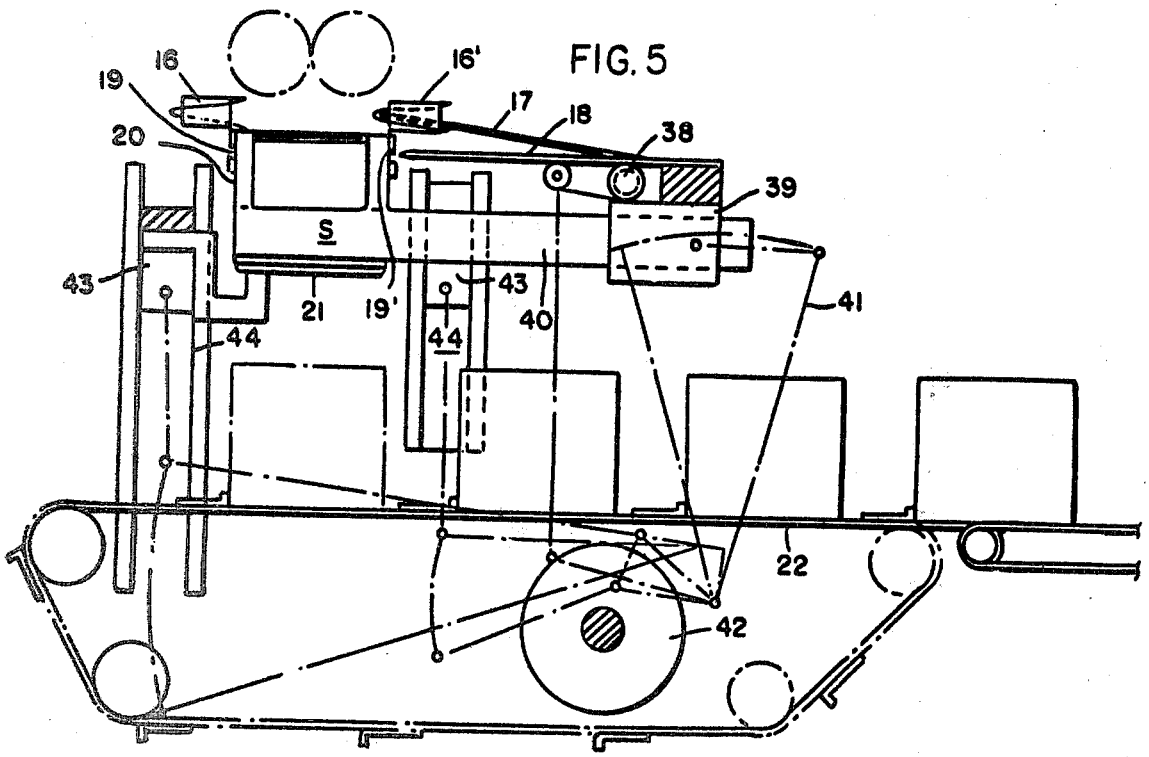
FIG. 5 is a fragmentary side elevational view of the folding, stacking and takeaway portions of the business form machine of FIG. 1, being in smaller scale than FIG. 1 and featuring the mechanical connections providing the movements of various elements to be described in conjunction with FIG. 1.

Although the grippers are mechanically controlled, it is advantageous to provide strippers 14 and 14' which are mounted on the frame 15 of the machine in conventional fashion. These serve to disengage a fold in the web from the gripper by virtue of passing through slots (not shown) in the grippers 12, 12'. Thereafter, the draped fold D is engaged by a pair of spirals 16 or 16', as the case may be. Reference to FIG. 4 shows that a pair of spirals 16 are provided for the left hand fold while a pair of spirals 16' are provided for the adjacent right hand fold. The spirals maintain the adjacent folds about to enter the stack S in spaced apart relation permitting the introduction of a separator member 17. The separator member 17 enters between the spaced apart spirals 16' and ultimately pivots downwardly into coplanar relation with flanked apart separator plates 18 (see particularly FIGS. 4 and 5). The plates 18 enter a slot 19' in a cage 20 confining the stack S.

By the use of the spirals 16, 16', it is possible to precisely position each fold at any given time. It is also possible to insert the narrow flat pointed separator member 17 between the spirals and pivot the separator member 17 to a position below the spiral 16' for it to become part of an overall wide board consisting of the plates 18, 18' that travels downwardly and forwardly and through slot 19 until the bonds in the perforation are broken. The stack below the board made up of elements 17, 18 is supported by elevator fingers 21 (see FIG. 5) that travels downward to deposit the stack S on a conveyor 22.

As soon as the conveyor 22 has removed the stack, the elevator fingers 21 travel upward, stop and start descending at a slow increase in speed. The wide board (17, 18) above carrying a new stack descends and catches up with the elevator fingers whereupon it withdraws and moves upward for the next cycle.

Returning now to FIG. 1, the geometry of the folding members 11, 11' will now be described. As pointed out previously, the web W is advanced or fed to the folding members by means of pin belts or the equivalent via the line holes in the control margins of the web. The web, prior to being fed to the folding members 11, 11' is transversely perforated by means not shown but normally along lines that are longitudinally spaced eleven inches apart—this being the most popular size in the industry currently.

In the illustration given with reference to FIGS. 1–12, I provide the distance between centers of the folding members 11, 11' (alternatively the axes of rotation) equivalent to the pitch diameters of their mating gears at six inches. The mating gears are designated 23 and 23' (see FIG. 2).

As pointed out previously, each folding member carries one gripper and one tucker. The circumferential distance between each corresponds to the normal repeat dimension of eleven inches. Thus, twenty-two inches of web travel equals one revolution of each folding member.

Each gripper is seen to include an anvil 24 or 24' and the anvil outer surface has a radius of $$3.500'' \begin{array}{l} +.000. \\ -.002 \end{array}$$

This radius times $2\pi$ equals a circumference of a few thousandths of an inch less than twenty-two inches. The tips of the gripper anvils 24, 24' in this instance then extend one-half inch beyond the gear pitch line. On the other hand, the tips of the tuckers 13, 13' are well within the pitch line as specified in U.S. Pat. No. 3,195,882 to which reference may be had for additional details of construction not set forth here. For example, the actuation of the gripper elements 25 and 25' is accomplished by means of cams and cam followers such as are designated 26, 26' in FIG. 2.

Referring again to FIG. 1, the outer surface of each anvil 24, 24' extends 50° upstream from the point where the anvil is contacted by the associated gripper element 25 or 25', as the case may be. The balance of the folding members is smaller in diameter to clear the mating anvil surface as well as the gripper element and confines the web against the anvile 24', 24.

With the folding action developed by the above described tuckers and grippers, it is not only superfluous, but undesirable to have a surplus of paper above or upstream of the engaged grippers and tuckers. This is because the outer surface or tip of the gripper anvil 24, 24' travels at the paper speed and the surplus needed for gripping comes from below or downstream. With folding members constructed according to my prior U.S. Pat. No. 3,195,882, the tucker hunted and found a weakness (the cross perforation) in the paper. Here, it is possible to mechanically and accurately position the tucker to the perforation. The perforation does have width and by positioning the tucker slightly downstream or upstream in relation to the prforation, the resulting folded stack may be corrected from a forward or rearward lean to square.

Reference is now made to FIGS. 6–11 of the drawing which constitute a series of fragmentary schematic showings of the relationship of the tucker, gripper and web portions involved in a folding operation performed according to the practice of this invention. In particular, for example, in FIG. 6, it is seen that the gripper anvil element is shaped as to provide a tip as at A while the gripper element 25 has a tip as at G and the tucker element 13' has a tip as at T. The web W is seen to be in the process of folding about a line of perforation L. As indicated previously, during the time the tucker tip T is in the process of entering the gripper 12 (viz., FIGS. 6–8), the space between the tips A and T as represented by the distance "a" remains constant. The geometry is so organized that the distance between the tips T and G also remains constant during tucker tip entry into the gripper, viz., FIGS. 6–8 and as represented by the symbol "b". Further, in the practice of the invention, I prefer to have the distances or dimensions "a" and "b" being equal.

Figures 6, 7, 8, 9, 10, 11, 12:
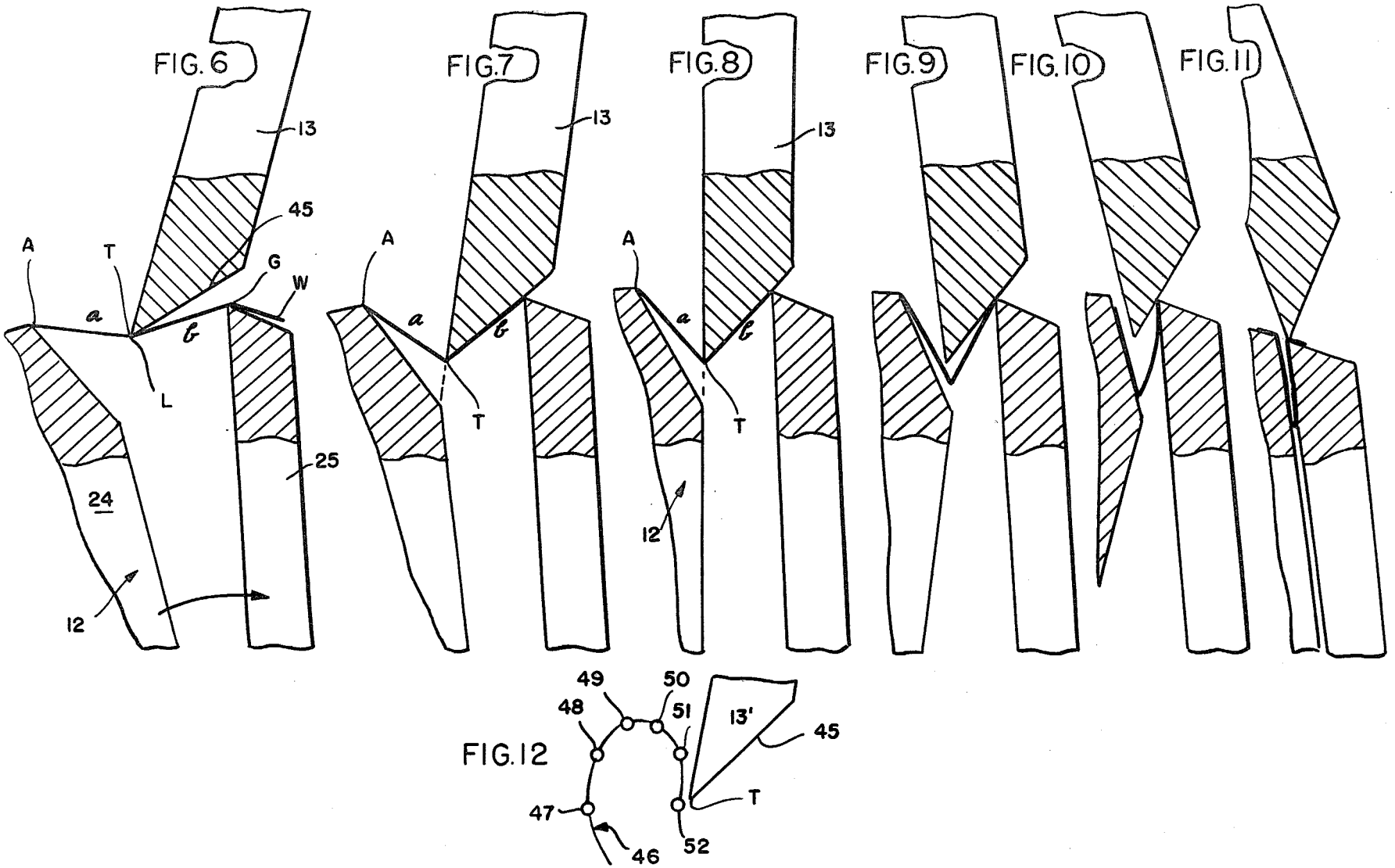
FIGS. 6–11 are schematic views showing the gripper closing relative to a web being folded.
FIG. 12 is a schematic view showing the projected path of gripper anvil tip travel relative to the tucker tip.
Figures 13, 14, 15, 16, 17, 18:
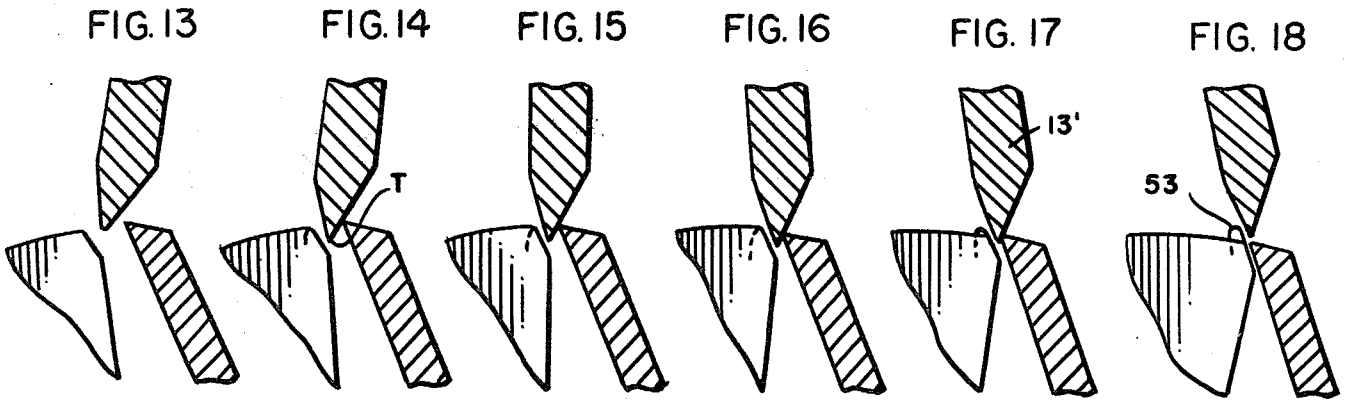
FIGS. 13–18 are views similar to FIGS. 6–11 but for folding rolls being spaced apart a greater distance.

The second mode or facet of the folding is illustrated in FIGS. 9–11, this conveniently being referred to as the "gripping" mode as contrasted to the "entering" mode represented in FIGS. 6–8. The tucker tip T is moving more and more into the gripper 12 and as FIG. 8 reaches its maximum depth or penetration. Thereafter, the tucker tip effectively is withdrawing from the gripper as can be appreciated from a consideration of FIGS. 9–11.

As has been brought out previously, the tip A of the gripper anvil 24 is traveling at the rate of web travel. Thus, the tucker tip T forces the perforated line L of the web down between the gripper anvil 24 and the gripper element 25. As has been brought out during this inward or entering movement of the tucker tip, the distances a and b remain fixed so that the web is essentially captured or fixed relative to the gripper 12. From this, it will be appreciated that if the position of the tucker tip T can be changed relative to the position of the tip A of the gripper anvil—particularly if this change is slight—the tip T of the tucker will engage a slightly different portion of the line of perforation L and therefore correct or at least alter the lean of a stack developed from the folding operation.

Figures 2, 3:
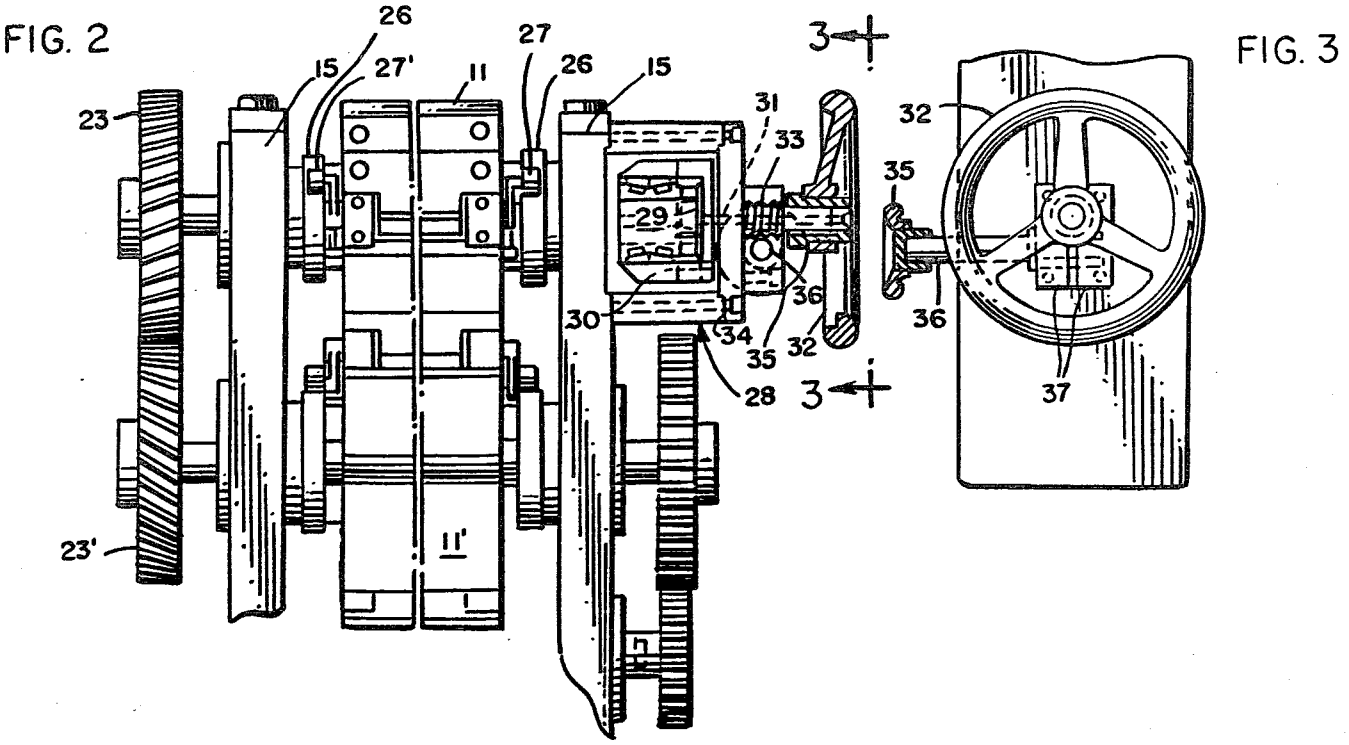
FIG. 2 is a top plan view of the folding portion of the machine of FIG. 1 and features the gearing and adjustment mechanism for eliminating stack "lean"
FIG. 3 is a side elevational view of the adjustment mechanism of FIG. 2 and such as would be seen along the sight line 3—3 applied to FIG. 2.

This correction or adjustment is achieved through the use of the helical gears 23, 23' and more particularly the adjustment means generally designated 28 in FIG. 2.

Referring now to FIG. 2, the shaft 29 of the folding member or partial roll body 11 is seen to be mounted in a movable bearing housing 30. The housing 30 is moved axially by virtue of a shaft 31 by turning the hand wheel 32 fixed thereto. The shaft 31 is supported within a threaded block 33 provided as part of an enclosure 34 secured to the frame 15. Thus, as the hand wheel 32 is turned, the shaft 31 positions the movable bearing housing 30 axially to the right or left thereby turning the folding member 11 slightly in an angular fashion because of the engagement of the helical gears 23 and 23'.

In FIG. 3, a locking mechanism is shown for the adjusting mechanism 28. This includes a hand wheel 35 which is affixed to a cross shaft 36. The cross shaft 36 operates a pair of clamping blocks 37 which engage the shaft 31 and immobilize the same against turning.

The strippers and the centrifugal force developed in the drape D (FIG. 1—see the dashed line designations of the movement thereof) causes the fold to skate tangentially along the strippers 14, 14' to the revolving spirals 16, 16'. The spirals 16, 16' turn at the same RPM as the folding rolls and in this way there is plenty of room for the next newly folded web to be deposited by a gently rolling action.

As mentioned previously, the separator member 17 pivots downwardly between the spirals 16'. This is achieved by mounting the separator member 17 on a pivot as at 38 (see FIG. 5) provided as part of the carriage 39 supporting the plates 18. As mentioned previously, the plates 18 are aligned with the slot 19 so as to pass between the folds previously separated by the separator member 17. Movement of the plates 18 to the left (as illustrated) is achieved by moving the carriage 39 along a slide 40. The slide 40 is provided as part of the cage 20 and the actuation of the carriage 39 is provided by a pivot arm illustrated schematically and designated by the numeral 41 being actuated by means of cam followers associated with a cam 42.

Movement of the cage 20 in the vertical direction is achieved by supporting the same on blocks 43 mounted in vertical ways or guides 44 which are actuated also by pivot arms actuated by the cam 42. The upper members of slot 19' are spaced apart to provide an opening for separator member 17 to pass through.

Reference is now made to FIG. 12 which is a showing of the projected path of the tip A relative to the tucker 13'. It will be appreciated that the tucker 13' has its bevel 45 facing the direction of rotation indicated by the arrow applied to FIG. 6. Immediately rearward of the tucker 13' is a pattern or line segment generally designated 46. This pattern 46 is the projected path of the tip A of the gripper anvil 24 on the folding member 11'. In other words, the point 47 in FIG. 12 represents the position of the tip A relative to the tip T as the two are related in FIG. 6. In similar fashion, the point designated 48 corresponds to the position of the tip A as it is seen in FIG. 7 and relative to the tip T. The point 49 corresponds to the location of the tip A relative to the tip T as the same are seen in FIG. 8. FIG. 8, it was pointed out, represents the relationship of the parts at the moment of deepest penetration of the tucker 13' into the gripper 12. The points 50, 51 and 52 correspond to the locations of the tip A of the gripper anvil 24 relative to the tip T of the tucker 13' (or 13, as the case may be).

Still referring to FIG. 12, it will be noted that the points 47, 48 and 49 lie on the arc of a circle of which the tip T is the center. It will also be appreciated that the curve or path 46 is positioned relative to the tip T so that the latter is just outside of the former, i.e., the tip T is just to the right of the portion of the path between the points 51 and 52.

Reference is now made to FIGS. 13–18 which correspond essentially to FIGS. 6–11 but wherein the center distance between the rolls is 6⅝" as contrasted to the 6" illustrated in FIGS. 6–11. This results, as can be appreciated from a consideration of FIG. 18 (at 53) in a much smaller projected path of the tip of the gripper anvil A, viz., a much less penetration of the tucker tip into the gripper. However, the relationship previously described relative to maintaining a constant distance between the tip A of the gripper anvil 24 and the tip T of the tucker 13' applies so that ready adjustment of the machine is possible merely by adjustment of the helical gears 23, 23' which reposition the tip T of the tucker 13, 13' relative to the line of perforation L.

It should also be appreciated that through this means the correction is doubled. For example, if the tucker 13' is advanced relative to the gripper 12, this will necessarily result in the gripper 12' being advanced relative to the tucker 13 (see FIG. 1). Thus, the lean is addressed doubly, i.e., on both sides of the stack by virtue of a single adjustment.

The gripper-anvil tip and the tucker tip have the same angular velocities but since the tucker tip is on a shorter radius it backs up against the gripper-anvil tip during the gripping engagement. In relationship to the tucker the gripper-anvil tip orbits in a circular path from point of entry to its deepest penetration. The tucker tip must be located at the center of this circular path in order to be equidistant to the gripper-anvil tip during this period.

The gripper is cam-actuated and spring-loaded against the cam. By the contour of the cam 26, 26', the leading angle of the tucker the gripper tip is kept equidistant from the tucker tip from engagement to the point of deepest penetration. This distance is made to equal the distance between the gripper-anvil tip and the tucker tip. Thus from the moment of engagement to the point of deepest penetration the dimension from the tucker tip to the gripper anvil tip is kept constant and equal to the dimension from the tucker tip to the gripper tip. As the gripper-anvil tip travels at web speed there can be no slippage of the web over the 3 edges involved, namely the tips of the gripper-anvil, tucker, and gripper.

In relationship to the tucker the gripper-anvil tip orbits in what appears to be a partially elliptical path from the point of deepest penetration to disengagement. I have found the location of the tucker tip to be outside of this orbit so that there is no interference with the web during withdrawal of the tucker.

While in the foregoing specification, a detailed description of an embodiment of the invention has been set down for the purpose of illustration, many variations in the details hereingiven may be made by those skilled in the art without departing from the spirit and scope of the invention.

I claim:

1. In a method for zig-zag folding a web wherein a web is fed between a pair of rotating folding members, each member having at least one tucker and one gripper, said gripper having an anvil and a gripper element, all of said tucker, gripper anvil and gripper element being shaped to define a tip on each, said members being disposed relative to each other to position the tucker of one member in web tucking engagement with the gripper of the other member to cooperate in folding said web, the steps of perforating an elongated web along a plurality of longitudinally spaced apart transversely extending lines, advancing said web at a given speed between said members, moving the tucker of one member between an anvil and gripper element on the other member to fold the web substantially along a perforation line while maintaining each of said gripper anvil tip and gripper element tip a constant distance from the tip of said tucker during entry of said tucker into said gripper, repeating the above step of folding at succeeding perforation lines to form a zig-zag folded stack, said gripper anvil tip rotating at a speed equal to the web given speed, visually ascertaining the presence of lean in said stack, and angularly shifting the tucker of one member relative to the anvil and gripper element of the other to eliminate said lean.

2. In apparatus for zig-zag folding a web wherein a web is fed between a pair of rotating folding members, each member having at least one tucker and one gripper, said members disposed relative to each other to position the tucker of one member in web tucking engagement with the gripper of the other member to cooperate in folding said web, said gripper having an anvil and a gripper element and with all of said tucker, gripper anvil and gripper element being shaped to define a tip on each, means for perforating an elongated web along a plurality of longitudinally spaced apart transversely extending lines, means for advancing said web at a given speed between said members, means for moving the tucker of one gripper between an anvil and gripper element on the other member to fold the web substantially along a perforation line while maintaining each of said gripper anvil tip and gripper element tip a constant distance from the tip of said tucker during entry of said tucker into said gripper and for repeating the folding at succeeding perforation lines to form a zig-zag folded stack, said gripper anvil tip operating at a speed equal to the web given speed and means in said apparatus for angularly shifting the tucker of one member relative to the anvil and gripper element of the other to eliminate stack lean.

3. The apparatus of claim 2 in which said shifting means includes a helical gear for each of said folding member.

4. The apparatus of claim 2 in which cam means are associated with each member for actuation of the gripper element thereof, the contour of the cam means and the angular shape of said tucker being arranged to maintain constant the distance between the tucker tip and gripper element tip during entry of said tucker into said gripper.

5. The apparatus of claim 4 in which the distance between said tucker tip and gripper anvil tip during tucker entry is equal to the distance between said tucker tip and gripper element tip during tucker entry.

* * * * *